US010814657B2

(12) United States Patent
Juriasingani et al.

(10) Patent No.: US 10,814,657 B2
(45) Date of Patent: Oct. 27, 2020

(54) PRINT HEAD WITH SPLIT RENDERING OF PRINT JOBS

(71) Applicant: Entrust Datacard Corporation, Shakopee, MN (US)

(72) Inventors: Rajesh K. Juriasingani, Shakopee, MN (US); Thomas Wagener, Shakopee, MN (US)

(73) Assignee: Entrust Datacard Corporation, Shakopee, MN (US)

( * ) Notice: Subject to any disclaimer, the term of this patent is extended or adjusted under 35 U.S.C. 154(b) by 0 days.

(21) Appl. No.: 15/655,993

(22) Filed: Jul. 21, 2017

(65) Prior Publication Data

US 2018/0022132 A1 Jan. 25, 2018

Related U.S. Application Data

(60) Provisional application No. 62/365,084, filed on Jul. 21, 2016.

(51) Int. Cl.
*B41J 35/14* (2006.01)
*B41J 35/16* (2006.01)
(Continued)

(52) U.S. Cl.
CPC ..... *B41J 35/16* (2013.01); *B41J 2/315* (2013.01); *B41J 2/325* (2013.01); *B41M 3/14* (2013.01);
(Continued)

(58) Field of Classification Search
CPC ..... B42D 25/23; B42D 25/24; B41J 35/16; B41J 2/315; B41J 2/32; B41J 2/325;
(Continued)

(56) References Cited

U.S. PATENT DOCUMENTS 5,611,629 A * 3/1997 Paranjpe ..... B41J 2/325 347/172
5,795,084 A 8/1998 Harding et al.
(Continued)

FOREIGN PATENT DOCUMENTS

CN 1113184 A 12/1995
CN 1257448 A 6/2000
(Continued)

OTHER PUBLICATIONS

International Search Report and Written opinion of PCT/U52017/042808, dated Oct. 17, 2017.
(Continued)

*Primary Examiner* — Kristal Feggins
(74) *Attorney, Agent, or Firm* — Hamre, Schumann, Mueller & Larson, P.C.

(57) ABSTRACT

Systems and methods where multi-color graphics on a substrate are printed at a first resolution, and single color data is printed at a second, higher resolution using the same print head. The multi-color graphics can be a printed photograph of a person, a printed logo, or any printed feature that is printed using multiple colors. The single color data can be printed alphanumeric text such as a person's name, address, account number or any other data that is printed using a single color.

9 Claims, 1 Drawing Sheet

(51) Int. Cl.

| | |
|---|---|
| ***B41M 3/14*** | (2006.01) |
| ***B41J 2/325*** | (2006.01) |
| ***B41M 5/34*** | (2006.01) |
| ***B42D 25/23*** | (2014.01) |
| ***B42D 25/24*** | (2014.01) |
| ***B41J 2/315*** | (2006.01) |

(52) U.S. Cl.
CPC ..... *B41M 5/345* (2013.01); *B42D 25/23* (2014.10); *B42D 25/24* (2014.10)

(58) Field of Classification Search
CPC .. B41F 16/00; B41F 16/0006; B41F 16/0026; B41F 16/0033
See application file for complete search history.

(56) References Cited

U.S. PATENT DOCUMENTS

| | | | | |
|---|---|---|---|---|
| 7,398,972 | B2 | 7/2008 | Schuller et al. | |
| 7,434,728 | B2 | 10/2008 | Paulson et al. | |
| 7,852,367 | B2 * | 12/2010 | Shinotou | B41J 2/475 347/262 |
| 2002/0059880 | A1 * | 5/2002 | Klinefelter | B41J 2/17546 101/484 |
| 2004/0219349 | A1 * | 11/2004 | Paulson | G06K 19/06046 428/321.1 |
| 2011/0298857 | A1 * | 12/2011 | Maki | B41J 2/04581 347/15 |
| 2013/0010047 | A1 | 1/2013 | Hart | |
| 2015/0002568 | A1 | 1/2015 | Shimomura | |
| 2017/0106665 | A1 * | 4/2017 | Cronin | B41J 33/44 |

FOREIGN PATENT DOCUMENTS

| | | | |
|---|---|---|---|
| CN | 1781722 | A | 6/2006 |
| CN | 1887600 | A | 1/2007 |
| CN | 101031424 | A | 9/2007 |
| CN | 101148123 | A | 3/2008 |
| CN | 101300138 | A | 11/2008 |
| CN | 102343733 | A | 2/2012 |
| CN | 104626769 | A | 5/2015 |
| JP | 2009096073 | A | 5/2009 |
| JP | 2010023393 | A | 2/2010 |
| JP | 2012076308 | A | 4/2012 |

OTHER PUBLICATIONS

Extended European Search Report; European Patent Application No. 17831768.1, dated Feb. 27, 2020 (10 pages).
Chinese Office Action for corresponding Chinese Patent Application No. 2017800439487, dated May 9, 2020, with English translation (23 pages).

* cited by examiner

Fig. 1
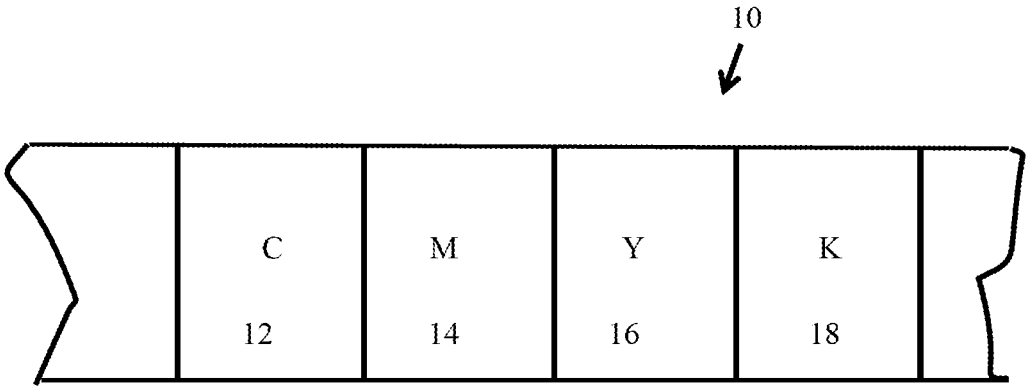
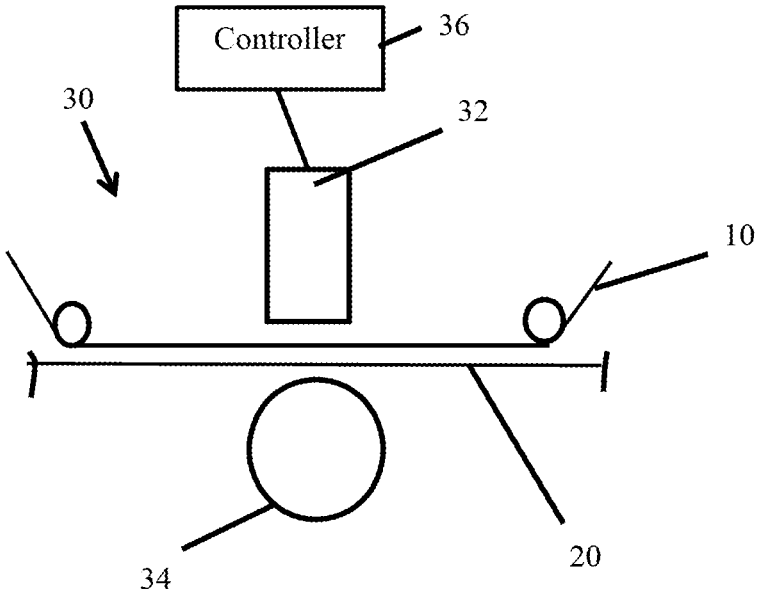
Fig. 2

PRINT HEAD WITH SPLIT RENDERING OF PRINT JOBS

FIELD

This disclosure relates to optimizing printing on substrates that include, but are not limited to, plastic cards, passport pages and retransfer films. The plastic cards can be cards such as financial cards including credit and debit cards, identification cards, driver's licenses, and other plastic cards that are personalized. The retransfer films can be any films on which an image is printed, and then the printed image is transferred to a substrate, such as a plastic card or a passport page.

BACKGROUND

When performing multi-color printing on substrates such as plastic cards, passport pages and retransfer films using a print head and a multi-color print ribbon, multi-color graphics such as a photograph and single color data such as text are typically printed at the same resolution. However, multi-color graphics and single color data do not necessarily require the same print resolution.

SUMMARY

Systems and methods are described where first printing is applied to a substrate by a print head at a first resolution and second printing is applied to the substrate by the same print head at a second resolution, which is higher than the first resolution. In one embodiment, systems and methods are described where multi-color graphics on a substrate are printed at a first resolution, and single color data is printed at a second, higher resolution. The multi-color graphics can be a printed photograph of a person, a printed logo, or any printed feature that is printed using multiple colors. The single color data can be printed alphanumeric text such as a person's name, address, account number or any other data that is printed using a single color. The printing sequence does not matter. The first printing at the first resolution can occur before the second printing at the second resolution. Alternatively, the second printing at the second resolution can occur before the first printing at the first resolution.

The substrate can be, but is not limited to, a plastic card, a passport page or a retransfer film. The plastic card can be a card such as a financial card including credit and debit cards, an identification card, a driver's license, and other plastic cards that are personalized. The retransfer film can be any films on which an image is printed, and then the printed image is transferred to a substrate, such as a plastic card or a passport page.

The methods described herein can be employed in any multi-color printing system. Examples of systems include, but are not limited to, a plastic card or passport personalization machines. One example of a plastic card or passport personalization machine is often termed a desktop personalization machine or desktop printer which is designed for relatively small scale, individual personalization and production of plastic cards or passports. Desktop card or passport printers have a relatively small footprint intended to permit the printer to reside on a desktop. Many examples of desktop printers are known, such as the SD or CD family of desktop card printers available from Entrust Datacard Corporation of Shakopee, Minn. Other examples of desktop printers are disclosed in U.S. Pat. Nos. 7,434,728 and 7,398,972, each of which is incorporated herein by reference in its entirety.

The plastic card or passport personalization machine is configured to perform multiple processing operations on a substrate such as a plastic card, a passport page, or a retransfer film. Processing operations that can be performed on the substrate (for example, the plastic card) include one or more of the following example processing operations: multi-color printing, monochromatic printing, laminating (for example, laminating the front and back of the plastic card), card cleaning (for example, cleaning the front and/or back of the plastic card), magnetic stripe encoding (for example, encoding a magnetic stripe on the plastic card), laser printing (for example, laser marking to create a useful pattern on the plastic card), embedded computer chip programming (for example, programming an integrated circuit chip on the plastic card), card de-bowing (for example, removing any bowing in the plastic card that may have occurred), indenting and embossing (for example, indenting and/or embossing character(s) on the plastic card).

The personalization machine for plastic cards or passports includes a cleaning mechanism for cleaning the front and/or back of the card, a color printing mechanism, a smart card mechanism for programming an integrated circuit chip on a card, a magnetic stripe encoding mechanism, and an optional other processing mechanism. The personalization machine for plastic cards or passports also includes two lamination mechanisms for laminating the front and back of the card, a debowing mechanism for removing any bowing in the card that may have occurred, and any other processing mechanism that may be desired.

DRAWINGS

FIG. 1 illustrates a multi-color ribbon.

FIG. 2 illustrates a print section of a printer that can utilize the methods described herein.

DETAILED DESCRIPTION

FIG. 1 illustrates a multi-color print ribbon 10 that includes a plurality of panels of cyan (C) 12, magenta (M) 14, yellow (Y) 16 and black (K) 18 (i.e. CMYK ribbon) that repeat in that sequence along the entire ribbon 10. In some embodiments, other panels can also be present such as topcoat panels and/or UV panels. The CMY panels 12, 14, 16 are used to print multi-color graphics on a substrate 20 (see FIG. 2) such as a plastic card, a passport page, or a retransfer film. The K panel 18 is used to print alphanumeric text on the substrate 20.

In some embodiments, the CMYK panels 12, 14, 16, 18 can be pigment, while in other embodiments the CMY panels 12, 14, 16 can be formed of dye while the K panel 18 can be a pigment. In many applications, printing with a dye can be performed at a lower print resolution than printing with a pigment.

As described further below, multi-color graphics on the substrate 20 are printed using the CMY panels 12, 14, 16 at a first print resolution, and single color data such as alphanumeric text is printed on the substrate 20 using the K panel 18 at a second, higher print resolution, where the printing is performed using the same print head.

FIG. 2 illustrates an example of a print section 30 of a printer that includes a print head 32 and a backing roller 34 positioned opposite the print head 32. The print head 32 can be a thermal print head of conventional construction. However, the print head 32 can be any type of print head that performs any type of printing. The print ribbon 10 is supplied from a print ribbon supply (not shown) with used print ribbon being wound up on a print ribbon take-up (not shown). The substrate 20 is transported into position in the print section using suitable transport mechanisms known in the art, and aligned with the print ribbon 10 using techniques known in the art for printing. Print data, including multi-color graphical data for printing at a first resolution using the print head 32 and single color data for printing at a second resolution is provided to the print head 32 by a controller 36.

When a print job on the substrate 20 is to be performed, multi-color graphics such as a photograph of an intended holder of the substrate 20, are printed by the print head 32 using the CMY panels 12, 14, 16 at a first print resolution. Any single color data, such as alphanumeric text like the person's name, address, account number or the like, is printed on the substrate 20 using the K panel 18 at a second, higher print resolution.

To help explain the concepts described herein, the following example is provided. This example assumes that the print head 32 is a 600 dpi print head. However, it is to be realized that the concepts described herein can be applied to print heads having other print resolutions as well. With a 600 dpi print head, printing of the multi-color graphics using the CMY panels 12, 14, 16 is relatively slow compared to printing using the K panel 18. However, in many instances, a lower print resolution can be used for the dye of the CMY panels 12, 14, 16 and still achieve adequate print quality. Therefore, one way to minimize the impact on printing throughput is to split the printing/rendering for the panels of the ribbon 10 at different resolutions. For example:

CMY panels 12, 14, 16 can be printed at 300 dpi; the K panel can be printed at 600 dpi.

The CMY panels can be printed at any resolution that is less than the resolution of the print head and less than the resolution at which the K panel is printed. Assuming the example of a 600 dpi print head, in one embodiment the CMY panels can be printed at a resolution that is less than 300 dpi. In another embodiment, the CMY panels can be printed at a resolution approximately equal to 300 dpi. In still another embodiment, the CMY panels can be printed at a resolution that is between about 300 dpi to about 450 dpi. In still another embodiment, the CMY panels can be printed at a resolution that is approximately equal to 450 dpi Any suitable technique can be used to perform the split the printing/rendering. For example:

1) One can use the same color data for two 600 DPI colors to create one 300 DPI pixel. This can be accomplished using suitable software.
2) Loading of two pixels can be accomplished using suitable electrical hardware.
3) Time-based loading could be performed to print at the lower resolution using the higher resolution print head. For example, data can be loaded at ½ the rate and the print head can be fired/activated using the same data twice.

Advantages of the split printing/rendering described herein include a reduction in client/server rendering time, data bandwidth advantages specially with cloud applications, color profiling and other enhancements for lower print resolution are faster on embedded systems, and printer throughput is increased.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A printing method in a personalization machine for plastic cards or passports, the method comprising:

printing on a plastic card, a passport page, or a retransfer film at a first resolution using a thermal print head and at least a first panel section of a ribbon supply located in the personalization machine; and printing on the plastic card, the passport page, or the retransfer film at a second resolution that is higher than the first resolution using the thermal print head and a second panel section of the ribbon supply located in the personalization machine.

2. The printing method of claim 1, further comprising:

printing multi-color graphical data on the plastic card, the passport page, or the retransfer film at the first resolution using the thermal print head; and printing single color data on the plastic card, the passport page, or the retransfer film at the second resolution using the thermal print head, wherein the multi-color graphical data comprises a photograph of a person or a logo, and the single color data comprises alphanumeric text.

3. The printing method of claim 2, further comprising:

printing the multi-color graphical data using cyan, magenta and yellow print ribbon panels, and printing the single color data using a black ribbon panel.

4. A plastic card, a passport page, or a retransfer film having a printed image that is printed according to the method of claim 1.

5. The printing method of claim 1, further comprising at least one of the following:

laminating a surface of the plastic card;

programming an integrated circuit chip on the plastic card;

encoding a magnetic stripe on the plastic card.

6. A personalization machine for plastic cards or passports, the personalization machine comprising:

a thermal print head; and a controller that controls the thermal print head to print multi-color graphical data on a plastic card, a passport page, or a retransfer film using the thermal print head and at least a first panel section of a print ribbon at a first resolution, and to print single color data on the plastic card, the passport page, or the retransfer film using the thermal print head and a second panel section of the print ribbon at a second resolution that is higher than the first resolution.

7. The personalization machine of claim 6, wherein the personalization machine includes a lamination mechanism, a smart card mechanism, and/or a magnetic stripe encoding mechanism.

8. A personalization printer for plastic cards or passports, the personalization printer comprising:

a thermal print head;

a multi-color print ribbon that includes a first panel section and a second panel section; and a controller operably coupled to the thermal print head to control operation of the thermal print head, wherein the controller can control the thermal print head to print multi-color graphical data on a plastic card, a passport page, or a retransfer film at a first resolution using the thermal print head and at least the first panel section; and print single color data on the plastic card, the passport page, or the retransfer film at a second, higher resolution using the thermal print head and the second panel section.

9. The personalization printer of claim 8, wherein the personalization printer includes a lamination mechanism, a smart card mechanism, and/or a magnetic stripe encoding mechanism.

* * * * *